US006454138B1

(12) United States Patent
Greenhill et al.

(10) Patent No.: US 6,454,138 B1
(45) Date of Patent: Sep. 24, 2002

(54) CARTRIDGE DISPENSING GUN

(75) Inventors: Silviu Greenhill, Bentleigh; Robert Urqhart Connell, Hawthorn, both of (AU)

(73) Assignee: Cetram Pty Limited, Victoria (AU)

( * ) Notice: Subject to any disclaimer, the term of this patent is extended or adjusted under 35 U.S.C. 154(b) by 0 days.

(21) Appl. No.: 09/867,739

(22) Filed: May 31, 2001

(51) Int. Cl.[7] ..... B67D 5/00
(52) U.S. Cl. ..... 222/391; 222/137; 222/327
(58) Field of Search ..... 222/137, 145.1, 222/145.3, 145.4, 145.5, 145.6, 327, 391

(56) References Cited

U.S. PATENT DOCUMENTS

| | | | | |
|---|---|---|---|---|
| 2,705,463 A | * | 4/1955 | Moore | 222/137 |
| 2,826,339 A | * | 3/1958 | Maillard | 222/137 |
| 4,690,306 A | | 9/1987 | Staheli | |
| 5,139,171 A | * | 8/1992 | Mader | 222/137 |
| 5,295,613 A | | 3/1994 | Barthomeuf et al. | |
| 5,301,842 A | * | 4/1994 | Ritter | 222/137 |
| 5,310,091 A | * | 5/1994 | Dunning et al. | 222/135 |
| 5,566,860 A | * | 10/1996 | Schiltz | 222/137 |

FOREIGN PATENT DOCUMENTS

| | | |
|---|---|---|
| AU | 52576/93 | 7/1994 |
| DE | 197 44 746 | 4/1999 |
| GB | 2019952 | 11/1979 |

* cited by examiner

*Primary Examiner*—J. Casimer Jacyna
(74) *Attorney, Agent, or Firm*—Lowe Hauptman Gilman & Berner, LLP

(57) ABSTRACT

A manually operably cartridge dispensing gun(1) for cartridges of the kind containing two components, said gun including a bed(2) to captively retain the cartridge, a manually operable drive assembly to advance inner(4) and outer (5) concentrically arrranged piston pushers against corresponding pistons in the cartridge, the outer piston pusher(5) being dimensioned to bear against a circumferentially outermost piston in the cartridge and including a central aperture to accomodate the inner piston pusher(4) of a first dimension for use with an inner piston of a cartridge having a first component ratio, said inner piston pusher(4) being selectively reconfigurable to a second, reduced, dimension for use with an inner piston of a cartridge having a second component ratio.

23 Claims, 5 Drawing Sheets

CARTRIDGE DISPENSING GUN

FIELD OF THE INVENTION

This invention relates to cartridge dispensing guns for cartridges of the kind containing two separate components.

BACKGROUND OF THE INVENTION

Disposable cartridges containing various products such as adhesives, sealants and the like are well known throughout many industries. The contents are usually expelled from the cartridges by means of a gun that acts against a piston contained within the cartridge to expel the contents from an aperture at the other end of the cartridge. The guns typically include a bed to retain the cartridge and a piston pusher mechanism, usually having a trigger to incrementally advance a piston pusher on the end of a rod that extends into the cartridge to bear against the piston. Standard single component cartridges typically have a diameter of around 46 mm.

It is also known to use coaxial cartridges which dispense two components in a selected ratio. These cartridges are effectively formed by two coaxially arranged compartments each containing one of the two components and having a separate piston for discharge of the component. The two components are typically components of epoxy or polyester which when mixed in a selected ratio cure to form to form a hardened material. In this type of cartridge the two components are expelled from their respective separate compartments, passed through a static mixer and then some form of mixer nozzle for direct application. The cartridge dispensing guns used with these two component cartridges have a pair of coaxially arranged piston pushers that are simultaneously advanced by the same mechanism.

A difficulty arises because different types of materials require differing ratios between the two components contained within the cartridges. This is achieved by adjusting the diameter of the inner compartment so that the appropriate volumetric ratio between the components expelled by the same amount of linear movement of the corresponding pistons is achieved. Component ratios of 2:1, 8:1, and 10:1 are in common use. Another difficulty arises because coaxial cartridges have different capacities this changing the external diameter of the cartridge. These all require different cartridge dispensing guns.

It is an object of this invention to provide an improved cartridge dispensing guns for cartridges of the kind containing two components.

According to the present invention, there is provided a manually operable cartridge dispensing gun for cartridges of the kind containing two components, said gun including a bed to captively retain the cartridge, a manually operable drive assembly to advance inner and outer concentrically arranged piston pushers against corresponding pistons in the cartridge, the outer piston pusher being dimensioned to bear against a circumferentially outermost piston in the cartridge and including a central aperture to accommodate the inner piston pusher of a first dimension for use with an inner piston of a cartridge having a first component ratio, said inner piston pusher being selectively reconfigurable to a second, reduced, dimension for use with an inner piston of a cartridge having a second component ratio.

In a preferred embodiment the inner and outer piston pushers form a pusher assembly and the inner piston pusher is reconfigured by removing an element of the pusher assembly. For example, the pusher assembly can include a rod that is advanced having a threaded end that receives a correspondingly threaded pusher. The end of the rod can be of a diameter selected to correspond to the second reduced dimension when the threaded pusher element is removed.

Preferably, the outer piston pusher takes the form of a circular ring.

In a preferred configuration the outer piston pusher is removable enabling the gun to also be used with standard single component cartridges.

In the preferred form of the invention a central rod aligned with the longitudinal axis of the cartridge is advanced by the drive assembly. The inner piston pusher is mounted to one end of the rod. The outer piston pusher is concentrically mounted with the inner pusher by means of two parallel extending rods that attach to the central rod adjacent the end remote from the cartridge. Preferably, guide slots are formed in an end plate on the bed of the gun to guide the parallel rods and maintain the position of the outer pusher with respect to the inner pusher. The guide slots are preferably open so that the parallel rods can be resiliently displaced and disengaged from the guide slots in the end plate.

BRIEF DESCRIPTION OF THE DRAWINGS

One embodiment of the invention will be now be described, by way of example only, with reference to the accompanying drawings in which.

DETAILED DESCRIPTION OF THE DRAWINGS

Figure 1:
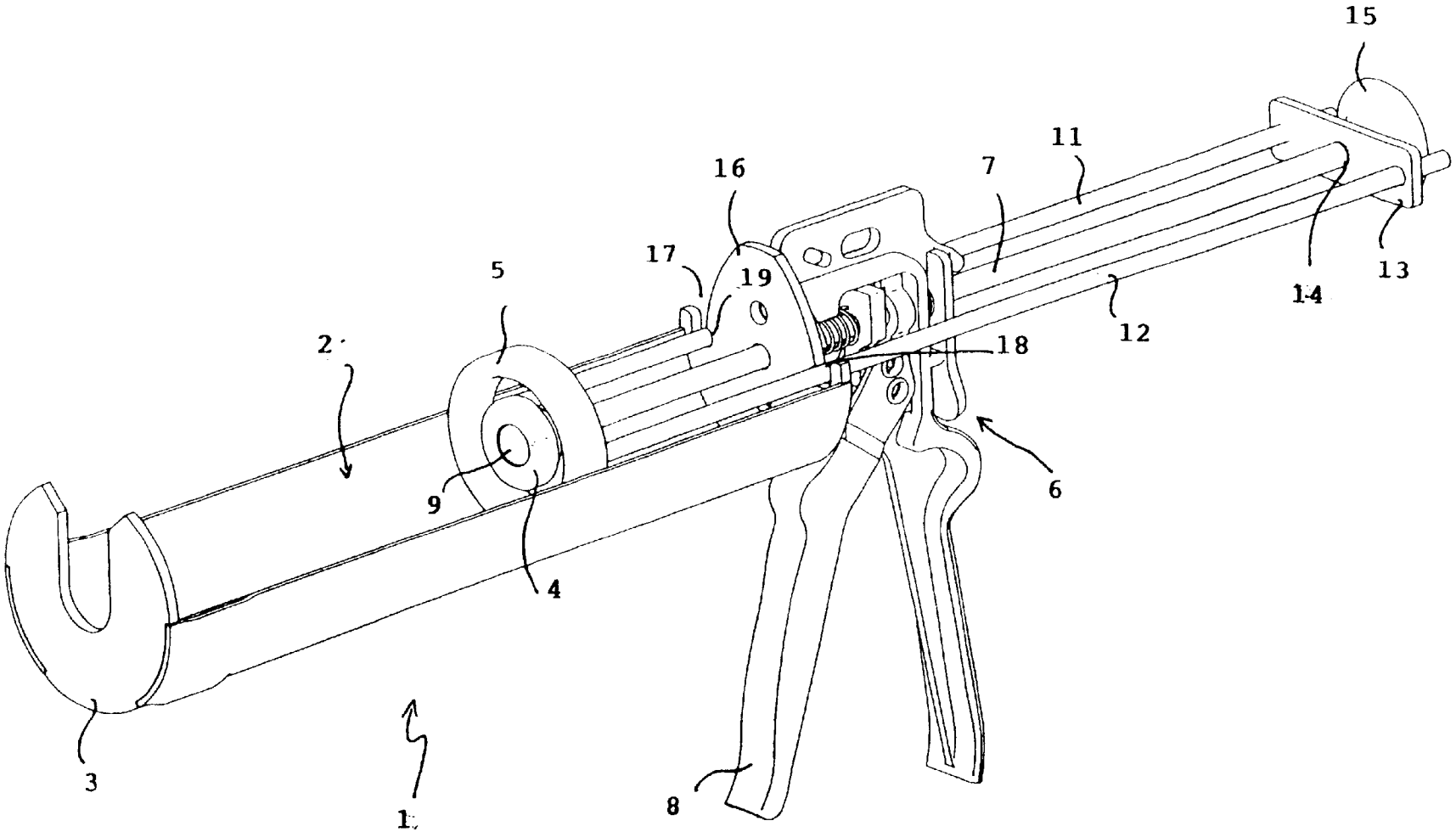
FIG. 1 is a perspective view of a cartridge dispensing gun according to this invention.
Figure 2:
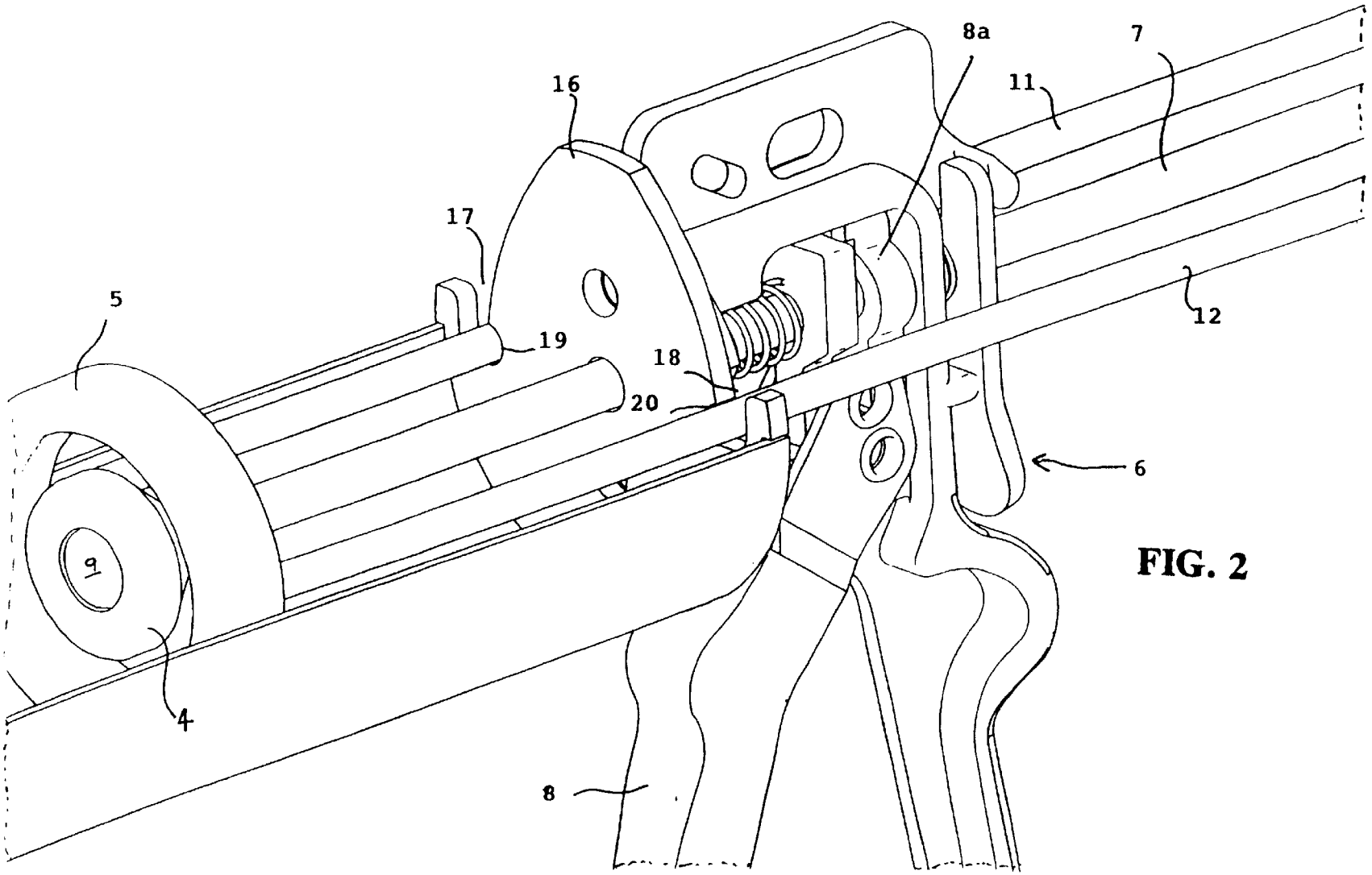
FIG. 2 is an enlarged view of part of FIG. 1 looking from the front of the gun.
Figure 3:
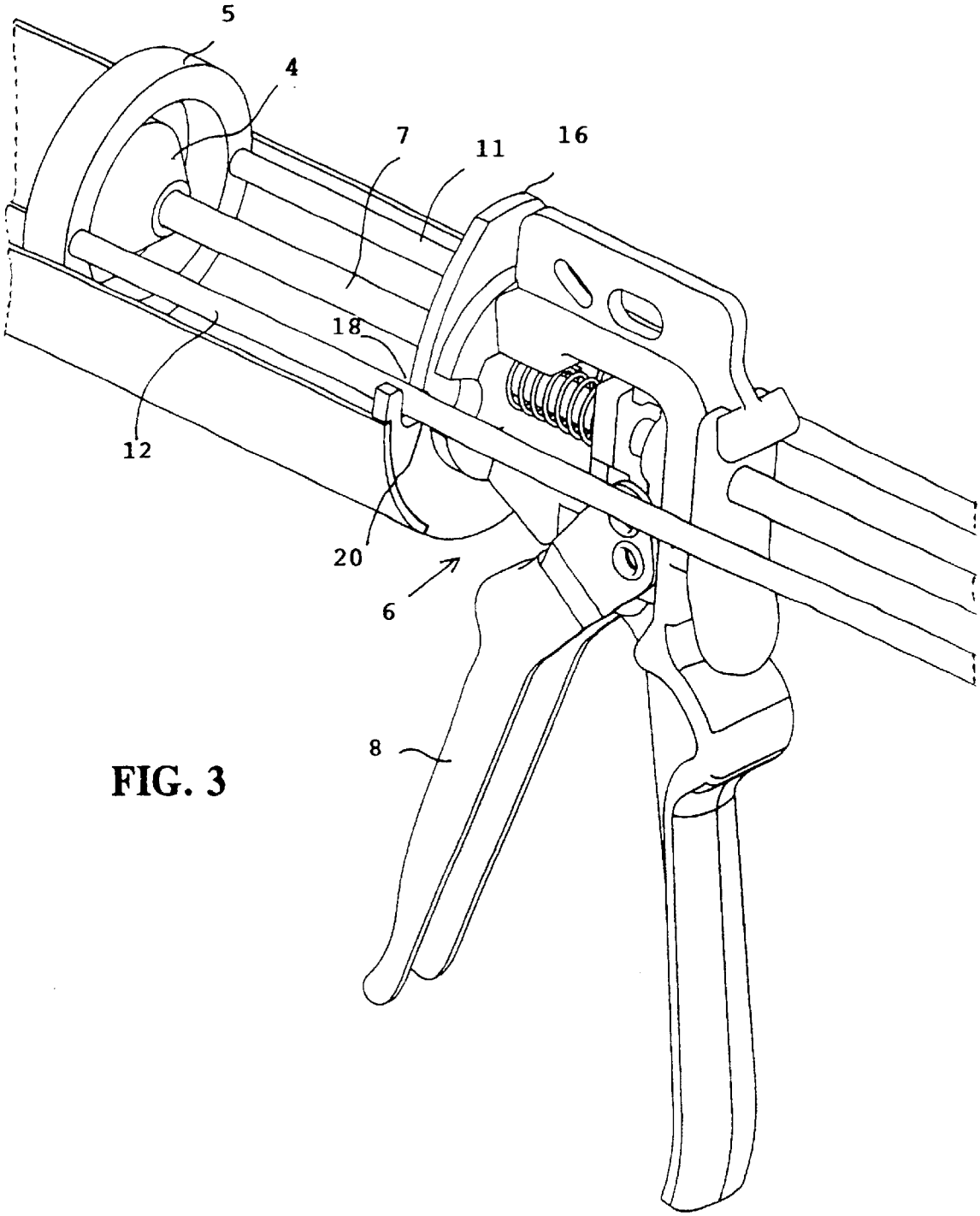
FIG. 3 is an enlarged perspective view of part of the gun shown in FIG. 1, looking from the rear of the gun.
Figure 4:
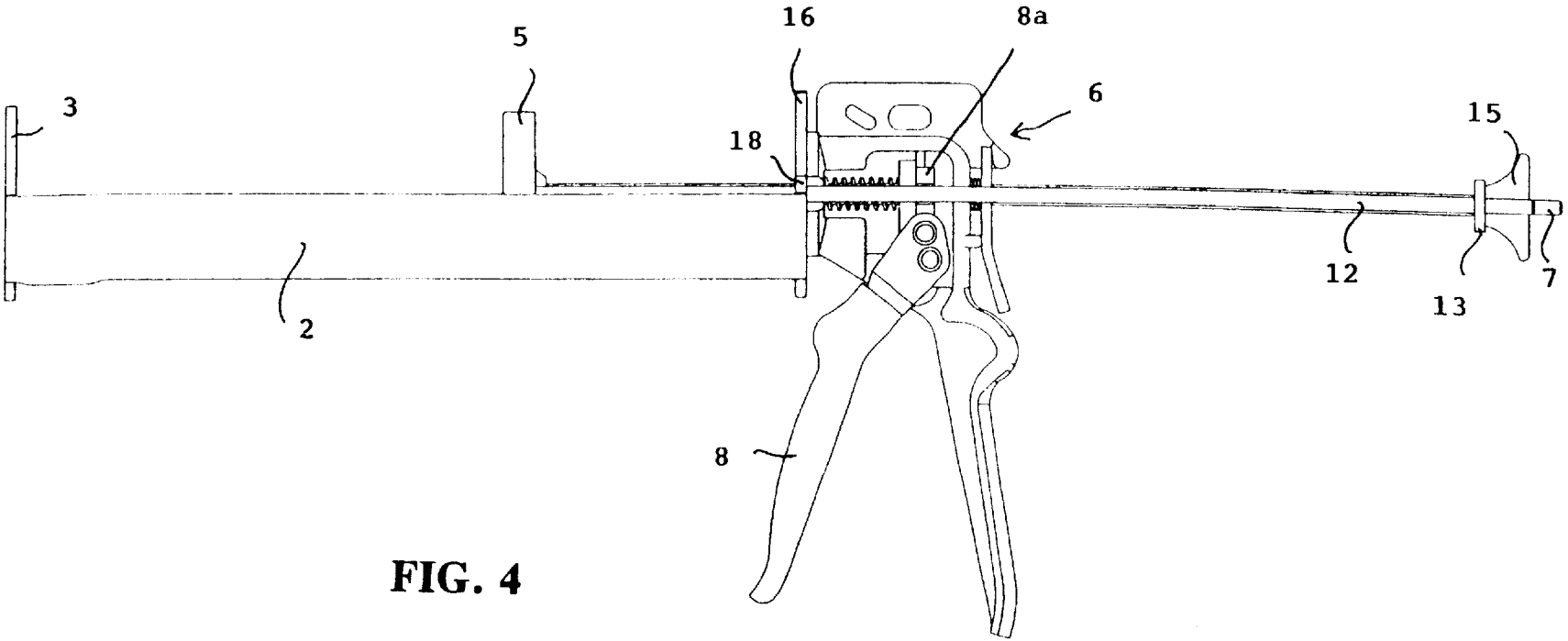
FIG. 4 is an elevation of the gun shown in FIG. 1.
Figure 5:
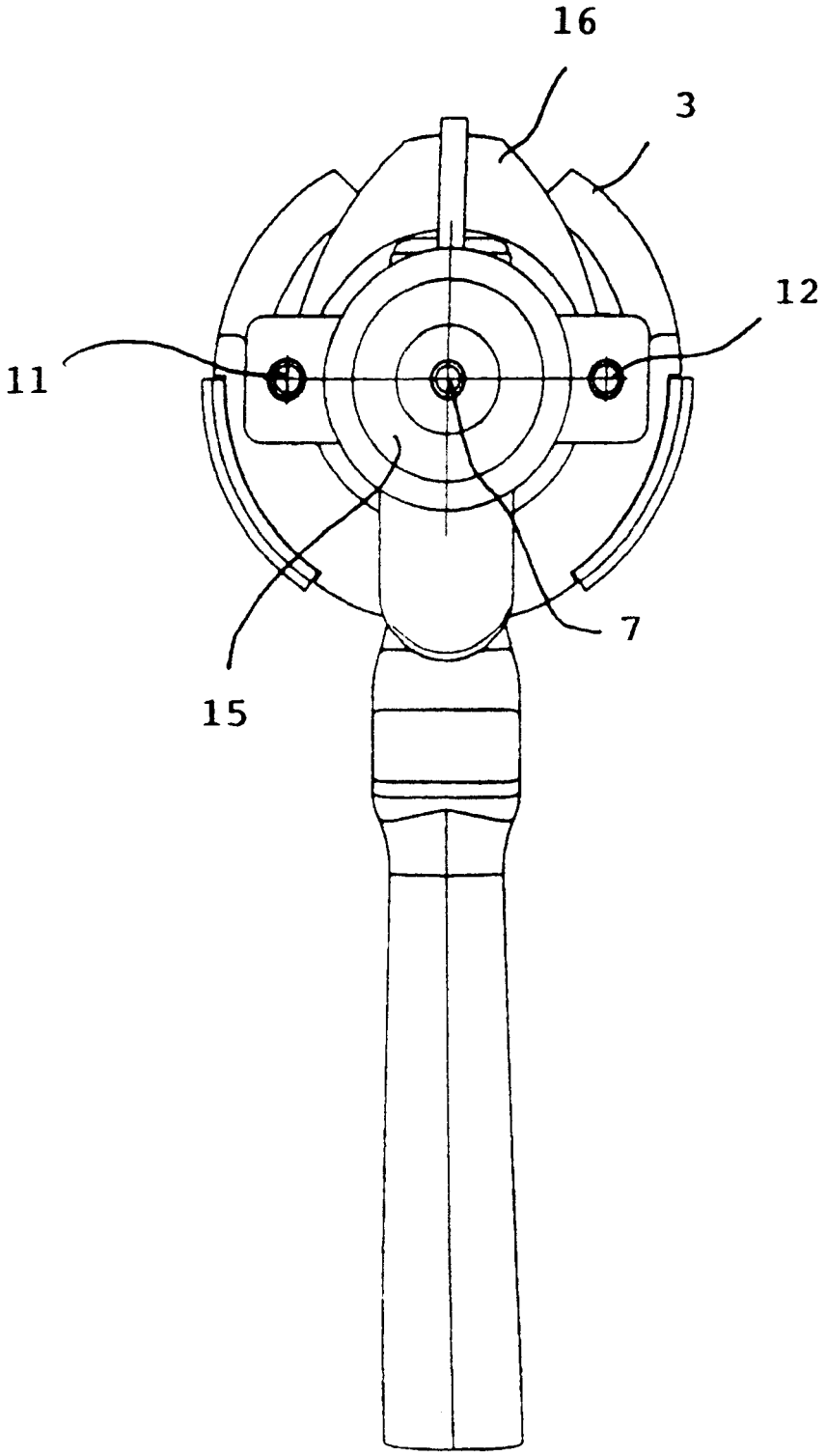
FIG. 5 is a rear end view of the gun shown in FIG. 1.

FIGS. 1 to 5 show a cartridge dispensing gun 1 for cartridges of the kind containing two components. The cartridges are not illustrated but will be well known to those skilled in the art and are essentially formed by inner and outer concentrically arranged compartments containing separate components. Each compartment is associated with a respective piston for discharge of the component. So-called Jumbo cartridges are typically of an outer diameter of approximately 66 mm, and standard cartridges are typically of an outer diameter of approximately 60 mm. In the case of a 10:1 two component cartridge the inner compartment typically is of the order of 19.5 mm in diameter. In a 2:1 component cartridge, the inner compartment diameter is approximately 37 mm. In the case of 8:1 cartridge, the outer diameter is typically 60 mm and the inner compartment diameter is approximately 19 mm.

The cartridge dispensing gun 1 is of the general type known to those skilled in the art. It includes a bed 2 and a front plate 3. The cartridge (not shown) is positioned in the bed 2 and the front end of the cartridge bears against plate 3. Concentrically-arranged piston pushers 4 and 5 are advanced by an advancing mechanism 6 to expel the contents of the cartridge. The advancing mechanism 6 includes a central rod 7 aligned with the longitudinal axis of the cartridge and is advanced by repeated operation of a manual trigger 8 which displaces a reciprocable dog or clutch 8*a* which engages with, and releases from, the rod 7 in known manner. The trigger 8, clutch 8*a* and its co-operation with the rod 7 form a drive assembly of the advancing mechanism; such drive assemblies are well known per se for guns of this type and will not be described in greater detail. The rod 7 carries an inner piston pusher 4 that corresponds to the dimension of the inner piston of a two component cartridge, say of the 2:1 type. That is, pusher 4 is slightly less than 37 mm in diameter. Piston pusher 4 is threadedly engaged with rod 7 at its forward end 9 and can be manually removed. The threaded end 9 of rod 7 is dimensioned to correspond to the dimension of a second smaller piston of the two component cartridge say of the 10:1 type. That is, the rod end 9 is slightly less than 19.5 mm in diameter.

The outer piston pusher 5 is annular in form and is mounted by two rods 11, 12 that extend parallel to rod 7. The rods 11, 12 are threadedly engaged with the outer pusher 5. The rear ends of rods 11 and 12 extend through a connecting plate 13, arranged transversely of rods 11, 12 and 7. The rods 11, 12 are secured to the connecting plate 13 by any suitable means. They can, for example, be threadedly engaged with the plate 13 or can be formed with a shoulder and an adjacent threaded portion that allows fastening nuts to secure the rod to the plate 13. Rod 7 is releasably secured to the connecting plate 13. This can be achieved by forming a shoulder 14 and an adjacent reduced diameter threaded end portion (not shown in detail) that receives a threaded knob 15. The plate 13 is clamped between the shoulder 14 and the threaded knob 15. The connecting plate 13 thus provides a fixed mechanical connection between rods 11, 12 and 7. Consequently the advancement of the rod 7 by the advancing mechanism 6 simultaneously advances rods 11 and 12. In use this means that piston pushers 4 and 5 advance together.

Alignment of rods 11 and 12 is provided by means of an end plate 16 at the rear end of bed 2 adjacent the advancing mechanism 6. The end plate 16 is formed with two open slots 17, 18 which include circular guide openings 19, 20. The openings 19, 20 are spaced to correspond to the spacing of rods 11 and 12 and open into slots 17, 18. The rods 11, 12 are releasably retained within the openings 19, 20 by a resilient snap action and can be released therefrom. The snap-in retention of the rods 11, 12 in the openings 19, 20 can be achieved by lateral flexing of the rods 11, 12 by passage along the opposed lateral edges of the end plate 16, these edges being laterally divergent as illustrated; alternatively snap-in retention can be achieved by detents at the edge of the openings such that the rods 11, 12 can be locked in the openings 19, 20 by the detents. The assembly comprising outer pusher 5, rods 11 and 12 and connecting plate 13 to be removed from the gun by first removing knob 15, disengaging rod 7 from plate 13 and releasing rods 11, 12 from the openings 19, 20. With this assembly removed, the gun has a single pusher 4 and can be used with standard single component cartridges. It is to be noted that when the rods 11, 12 are locked within the openings 19, 20, they are able to freely move longitudinally within the openings.

In the normal configuration with both piston pushers 4 and 5 in place the gun provides for dispensing of two component cartridges in the substantially known manner. However the ability to remove or reconfigure piston pusher 4 allows for the gun to be readily adapted for use with two component cartridges of different component ratios, or in other words different inner compartment diameters. With the piston pusher 5 removed, the gun can be used with single component cartridges. This adaptability of the cartridge gun of the present invention provides a significant advantage of allowing a single cartridge gun to be used for a range of different cartridges.

The foregoing describes only one embodiment of this invention and modifications can be made without departing from the scope of the invention.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

What is claimed is:

1. A manually operable cartridge dispensing gun for cartridges of the kind containing two components each in one of telescopic inner and outer compartments, said gun comprising:

a bed for captively retaining the cartridge; and a drive assembly for advancing inner and outer piston pushers against inner and outer pistons of the inner and outer compartments, respectively, the outer piston pusher including a central aperture to accommodate the inner piston pusher of a first dimension for use with an inner piston of a cartridge having a first component ratio, said inner piston pusher being selectively reconfigurable to a second, reduced, dimension for use with an inner piston of a cartridge having a second component ratio.

2. A gun according to claim 1, wherein the inner and outer piston pushers form a piston pusher assembly driven by the drive assembly, the inner piston pusher of said first dimension being formed by a first pusher element removably mounted in the assembly to permit reconfiguration to the second, reduced, dimension.

3. A gun according to claim 2, wherein the first pusher element is mounted on the end portion of a second pusher element of said second dimension whereby upon removal of the first pusher element the end portion of the second pusher element then forms the inner piston pusher.

4. A gun according to claim 3, wherein the first pusher element is threadedly mounted on the end portion of the second pusher element.

5. A gun according to claim 3, wherein the second pusher element is in the form of a first rod extending longitudinally of the gun and said drive assembly is operative to drive the piston pusher assembly by interaction with said rod.

6. A gun according to claim 5, wherein the outer piston pusher is mounted by further rods extending parallel to the first rod and operatively connected thereto so that driving of the first rod by the drive assembly also drives the further rods, the outer piston pusher and the further rods forming a sub-assembly which is removable from the pusher assembly to convert the pusher assembly for use with a single component cartridge.

7. A gun according to claim 6, wherein the first rod and the further rods are mounted for longitudinal sliding movement in a guide member formed at a rear end portion of the bed.

8. A gun according to claim 7, wherein the further rods are releasably retained in the guide member by a snap-in action.

9. A gun according to claim 6, wherein the further rods are releasably connected to the first rod by a connecting member at rear end portions of the first rod and the further rods.

10. A gun according to claim 2, wherein the outer piston pusher is removable from the pusher assembly to enable the gun to be converted for use with a single component cartridge.

11. A manually operable cartridge dispensing gun for a cartridge of a two-component type, the cartridge having an inner compartment telescopically received within an outer compartment, said gun comprising:

a bed extending in a longitudinal direction of said gun for captively retaining the cartridge;

inner and outer piston pushers corresponding to inner and outer pistons of the inner and outer compartments of the cartridge, respectively; and a drive assembly for advancing said inner and outer piston pushers in the longitudinal direction to bear against the corresponding inner and outer pistons in the cartridge;

wherein said outer piston pusher includes a central aperture for accommodating said inner piston pusher;

said inner piston pusher is selectively reconfigurable to different dimensions for use with different said cartridges having different component ratios; and said outer piston pusher is removably attached to said gun for allowing the gun to be converted for use with a cartridge of a single-component type.

12. The gun according to claim 11, wherein the outer piston pusher is mounted on an end of at least a first rod extending longitudinally of said gun and operatively connected to the drive assembly.

13. The gun according to claim 12, further comprising a guide member for releasably retaining the first rod while allowing the first rod to slide longitudinally of said gun.

14. The gun according to claim 13, wherein the guide member is formed at a rear end portion of the bed which is adjacent to the drive assembly.

15. The gun according to claim 13, wherein the first rod is releasably retained in the guide member by a snap-in action.

16. The gun according to claim 15, wherein the guide member comprises a central portion and a barb portion spaced from the central portion by a first guide opening for slidably guiding the first rod along the longitudinal direction and an open slot for leading the first rod into the first guide opening, said barb portion is laterally flexible towards and away from the central portion for retaining and releasing the first rod, respectively.

17. The gun according to claim 16, further comprising a second rod extending in parallel with the first rod and engaged with the drive assembly, the first rod is releasably connected to the second rod by a connecting member so that driving of the second rod by the drive assembly also drives the first rod.

18. The gun according to claim 17, wherein the connecting member is removably attached to the opposite end of the first rod.

19. The gun according to claim 17, wherein said inner piston pusher is mounted on an end of the second rod which is located within the central aperture of said outer piston pusher.

20. The gun according to claim 17, wherein the guide member further has a second guide opening through which the second rod extends.

21. The gun according to claim 15, further comprising a second rod extending in parallel with the first rod and engaged with the drive assembly, the first rod is releasably connected to the second rod by a connecting member so that driving of the second rod by the drive assembly also drives the first rod.

22. The gun according to claim 21, wherein the connecting member is removably attached to the opposite end of the first rod.

23. The gun according to claim 21, wherein said inner piston pusher is mounted on an end of the second rod which is located within the central aperture of said outer piston pusher.

* * * * *